US007120271B2

(12) United States Patent
Kobayashi et al.

(10) Patent No.: US 7,120,271 B2
(45) Date of Patent: Oct. 10, 2006

(54) INTERNAL MAGNETIC CIRCUIT AND LOUDSPEAKER SYSTEM INCORPORATING THE SAME

(75) Inventors: Hiroyuki Kobayashi, Yamagata-ken (JP); Hiroyuki Dohi, Yamagata-ken (JP); Shouichiro Terauchi, Saitama-ken (JP); Takashi Ohyaba, Saitama-ken (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 104 days.

(21) Appl. No.: 10/460,649

(22) Filed: Jun. 13, 2003

(65) Prior Publication Data

US 2004/0005075 A1 Jan. 8, 2004

(30) Foreign Application Priority Data

Jun. 19, 2002 (JP) ..... 2002-178329

(51) Int. Cl.
*H04R 1/00* (2006.01)

(52) U.S. Cl. ..... 381/414; 381/412; 381/420

(58) Field of Classification Search ..... 381/396, 381/400, 401, 412, 414, 420
See application file for complete search history.

(56) References Cited

U.S. PATENT DOCUMENTS

| | | | | |
|---|---|---|---|---|
| 6,611,606 | B1 * | 8/2003 | Guenther | 381/421 |
| 6,665,414 | B1 * | 12/2003 | Murayama et al. | 381/397 |
| 6,671,385 | B1 * | 12/2003 | Suzuki et al. | 381/412 |
| 2002/0044671 | A1 | 4/2002 | Shimomura et al. | |
| 2003/0133587 | A1 * | 7/2003 | Hyre et al. | 381/412 |

FOREIGN PATENT DOCUMENTS

| | | |
|---|---|---|
| JP | 6-261393 | 9/1994 |
| JP | 7-170598 | 7/1995 |

* cited by examiner

*Primary Examiner*—Sinh Tran
*Assistant Examiner*—Brian Ensey
(74) *Attorney, Agent, or Firm*—McGinn IP Law Group PLLC

(57) ABSTRACT

An internal magnetic circuit is formed by a plate forming a pole piece, a vertically magnetized magnet attached to a bottom face of the plate, and a yoke attached to a bottom face of the magnet. A magnetic gap is formed between the plate and the yoke. The yoke includes a bottom part attached to the bottom face of the magnet, a side part standing on the side of the plate, and a folded-back part folding downwards over the side part to face the magnetic gap. Thus, the internal magnetic circuit having a uniform magnetic flux density inside the magnetic gap along the direction of its length is provided.

7 Claims, 4 Drawing Sheets

INTERNAL MAGNETIC CIRCUIT AND LOUDSPEAKER SYSTEM INCORPORATING THE SAME

BACKGROUND OF THE INVENTION

The present invention relates to an internal magnetic circuit having a magnet, a yoke, and a plate, and a loudspeaker system incorporating the magnetic circuit.

The present application claims priority from Japanese Patent Application No. 2002-178329, the disclosure of which is incorporated herein by reference.

FIG. 1 shows one prior art example of a loudspeaker system incorporating an internal magnetic circuit disclosed in Japanese Patent Laid-Open Publication No. Hei 6-261393, and FIG. 2 is an explanatory view showing the internal magnetic circuit. A vertically magnetized magnet 2 and a plate 1 forming a pole piece are arranged inside a yoke 3 having a bottom part 3*a* and a side part 3*b* surrounding the plate 1. The magnet 2 is attached to the bottom face of the plate 1 and to the bottom part 3*a* of the yoke 3. An air gap or magnetic gap G is formed between the plate 1 and the yoke 3. The magnet 2, the yoke 3 on the side of one magnetic pole of the magnet 2, the plate 1 on the side of the other magnetic pole of the magnet 2, and the magnetic gap G form an internal magnetic circuit.

A voice coil bobbin 5 is arranged such as to surround the pillar-like plate 1 which forms the pole piece, so that a voice coil 4 is positioned inside the magnetic gap G. The voice coil bobbin 5 is supported on a frame 6 through a damper 7. The inner end of a diaphragm 8 is fixedly attached to the periphery of the voice coil bobbin 5, while the outer end of the diaphragm 8 is supported on the periphery of the frame 6 through an edge 8A. Reference numerals 9 and 10 represent a center cap and a gasket, respectively.

It is known that in such a loudspeaker system the winding width of the voice coil 4 relative to the effective length of the magnetic gap G has a close correlation with the distortion caused by the nonlinearity of drive force. Accordingly, a short voice coil design in which the voice coil 4 has a small winding width has been adopted so that even a maximum amplitude of the loudspeaker system does not cause the voice coil 4 to come out of the range of effective length of the magnetic gap G, whereby drive force variations in response to the input signal current are suppressed, and thus nonlinear distortion is prevented.

This short voice coil design has the effect of preventing nonlinear distortion on condition that the magnetic flux distribution in the magnetic gap G is uniform. In a conventional internal magnetic circuit, however, the magnetic flux density distribution inside the magnetic gap is not necessarily uniform particularly if it has a long effective length.

FIG. 2 shows the magnetic circuit formed by the magnet 2, the yoke 3 and plate 1 arranged on the opposite sides of the magnet 2, and the magnetic gap G. As shown, most of the magnetic flux lines form loops leaving from one magnetic pole of the magnet 2, passing through the bottom part 3*a* and side part 3*b* of the yoke 3, crossing the magnetic gap G, passing the plate 1, and entering the other magnetic pole of the magnet. The density of these magnetic flux lines tends to be high on the side of shorter loops, i.e., the nearer the loops are to the magnet 2, the higher the density is, and vice versa.

That is, within the effective length $X_0$–$X_1$ of the magnetic gap G, the magnetic flux density is higher on the $X_0$ side, while it is lower on the $X_1$ side. The magnetic flux density decreases in the direction of from $X_0$ to $X_1$ as shown in FIG. 3 within the effective length $X_0$–$X_1$, meaning that the magnetic flux density is not uniform in the direction in which the voice coil 4 moves.

Therefore, large amplitude vibration of the voice coil 4 located inside the magnetic gap G resulting from a large input signal may lead to the nonlinear distortion of sound signals. This is particularly evident in a loudspeaker system with the aforementioned short voice coil design.

SUMMARY OF THE INVENTION

The present invention has been devised to resolve the above problem, and an object of the present invention is to provide a magnetic circuit having uniform magnetic flux density inside the magnetic gap along the direction of its length, and thereby to provide a loudspeaker system capable of outputting sound with less distortion.

To achieve the above object, according to a first aspect of the present invention, an internal magnetic circuit includes a magnet, a yoke arranged on one magnetic pole of the magnet, and a plate arranged on the other magnetic pole of the magnet. A magnetic gap is formed between the yoke and plate. In this configuration, a magnetic flux density inside the magnetic gap is made uniform by elongating a magnetic path length of magnetic flux, at a near side to said magnet, extending across said magnetic gap.

According to a second aspect of the present invention, in the internal magnetic circuit configured as described above, the yoke includes a gap for allowing a magnetic flux loop extending across the magnetic gap to detour, so that the magnetic path length of magnetic flux can be elongated.

According to a third aspect of the present invention, in the internal magnetic circuit configured as described above, the yoke is made up of a bottom part attached to a bottom face of the magnet, a side part standing on a side of the plate, and a folded-back part which folds downward over the side part such as to face the magnetic gap.

According to a fourth aspect of the present invention, there is also provided a loudspeaker system incorporating the internal magnetic circuit in any one of the first to third aspects, wherein a voice coil is positioned inside the magnetic gap.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
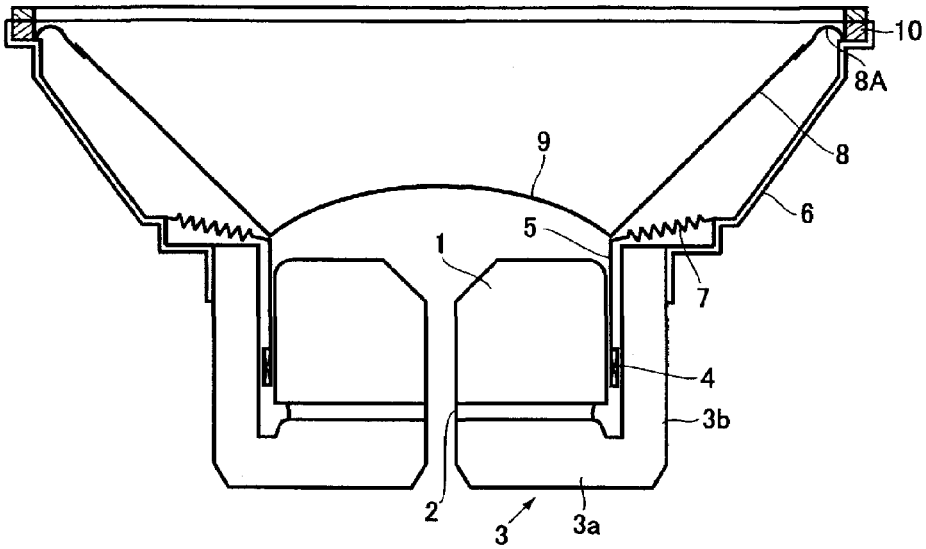
FIG.1 PRIOR ART
FIG. 1 is an explanatory view showing a conventional loudspeaker system incorporating an internal magnetic circuit.
Figure 2:
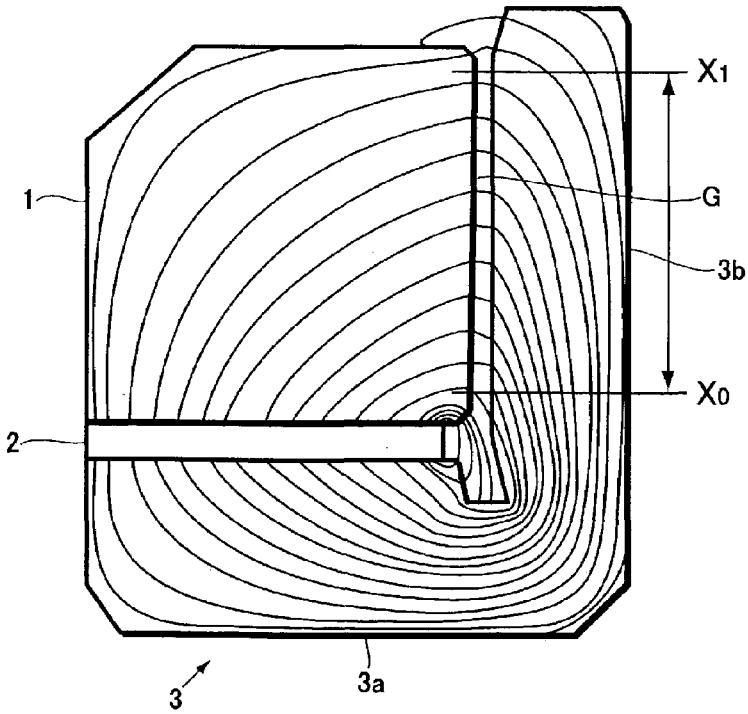
FIG.2 PRIOR ART
FIG. 2 is an explanatory view showing the internal magnetic circuit in the conventional loudspeaker system.
Figure 3:
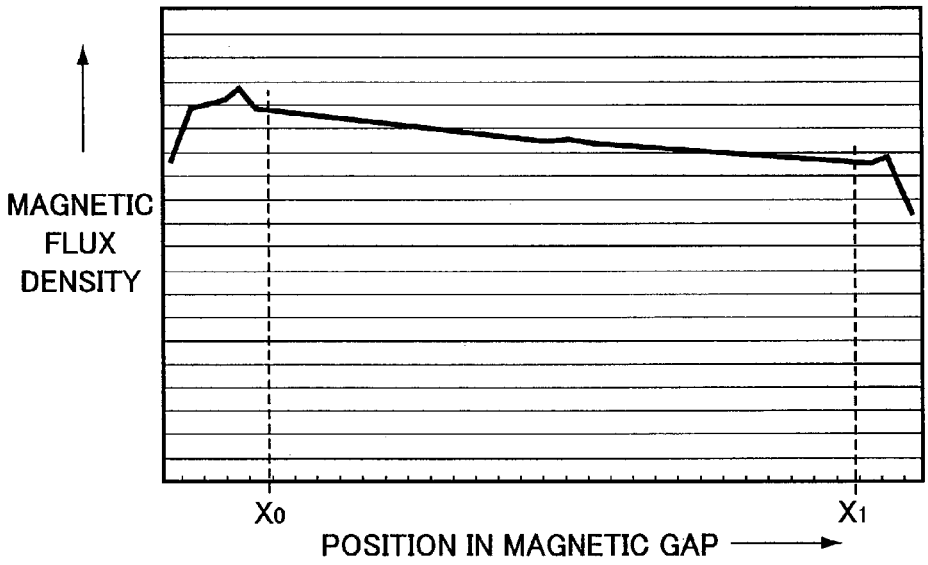
FIG.3 PRIOR ART
FIG. 3 is a graph showing the magnetic flux density inside a magnetic gap in the magnetic circuit with the conventional design.
Figure 4:
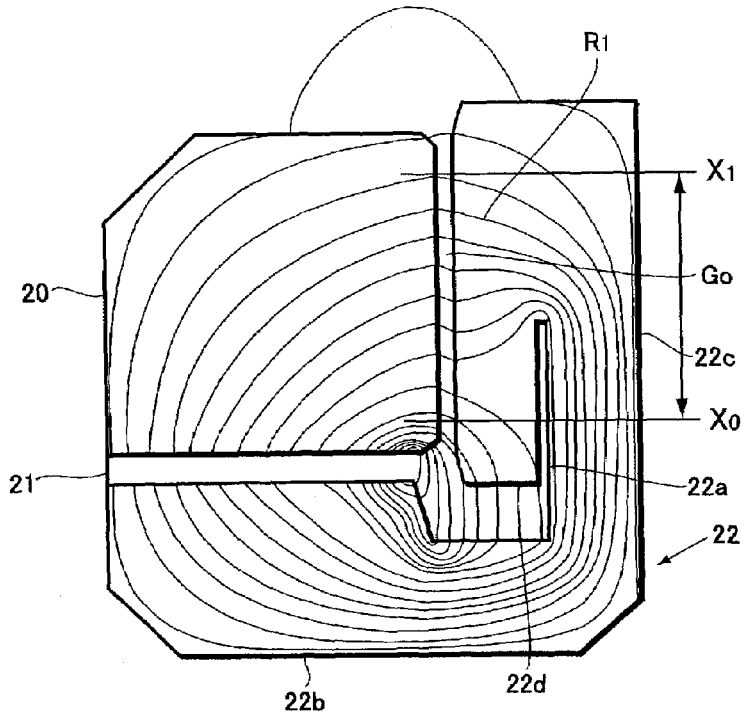
FIG. 4 is an explanatory view showing an internal magnetic circuit according to one embodiment of the present invention.

One embodiment of the present invention will be described below with reference to the accompanying drawings. FIG. 4 illustrates an internal magnetic circuit according to the embodiment of the present invention, which includes a plate 20 forming a pole piece, a vertically magnetized magnet 21 attached to a bottom face of the plate 20, and a yoke 22 attached to a bottom face of the magnet 21. Between the plate 20 and yoke 22 is formed a magnetic gap $G_0$.

The primary feature of this embodiment is that the magnetic flux density inside the magnetic gap $G_0$ is made uniform by elongating the magnetic path length of part of the magnetic flux crossing the magnetic gap $G_0$.

More specifically, in this internal magnetic circuit formed by the magnet 21, the yoke 22 and plate 20 arranged on opposite sides of the magnet 21, and the magnetic gap $G_0$, most of the magnetic flux lines form loops leaving from one magnetic pole of the magnet 21, passing through the yoke 22, crossing the magnetic gap $G_0$, passing through the plate 20, and entering the other magnetic pole of the magnet 21. Therefore, by elongating the magnetic path length of magnetic flux loops R1 crossing the magnetic gap G on the side nearer to the magnet 21, shorter loops are dispersed evenly in the range of the effective length $X_0$–$X_1$, whereby the magnetic flux density inside the magnetic gap $G_0$ is made uniform.

The secondary feature of the embodiment is that the yoke 22 is formed with a gap 22*a* for allowing the magnetic flux loops crossing the magnetic gap $G_0$ to detour. The gap 22*a* is formed opposite the magnetic gap $G_0$ parallel thereto in the yoke 22, so that the magnetic flux loops make a detour around the gap 22*a* before reaching the magnetic gap $G_0$. Accordingly, there is no concentration of shorter loops in the range of the effective length $X_0$–$X_1$ inside the magnetic gap $G_0$, and the magnetic flux density therein is made uniform.

The third feature of the embodiment is that the yoke 22 is made up of a bottom part 22*b* which is attached to a bottom face of the magnet 21, a side part 22*c* standing upright on the side of the plate 20, and a folded-back part 22*d* which extends from the side part 22*c* and folds over downwardly to face the magnetic gap $G_0$. With such a construction, the gap 22*a* can be formed between the side part 22*c* and folded-back part 22*d* of the yoke 22, without causing the yoke 22 to take up much space in the magnetic circuit. The gap 22*a* thus causes the magnetic flux loops to detour passing through the side part 22*c* of the yoke 22, so that there is no concentration of shorter loops in the range of the effective length $X_0$–$X_1$, and the magnetic flux density inside the magnetic gap $G_0$ can be made uniform.

Figure 5:
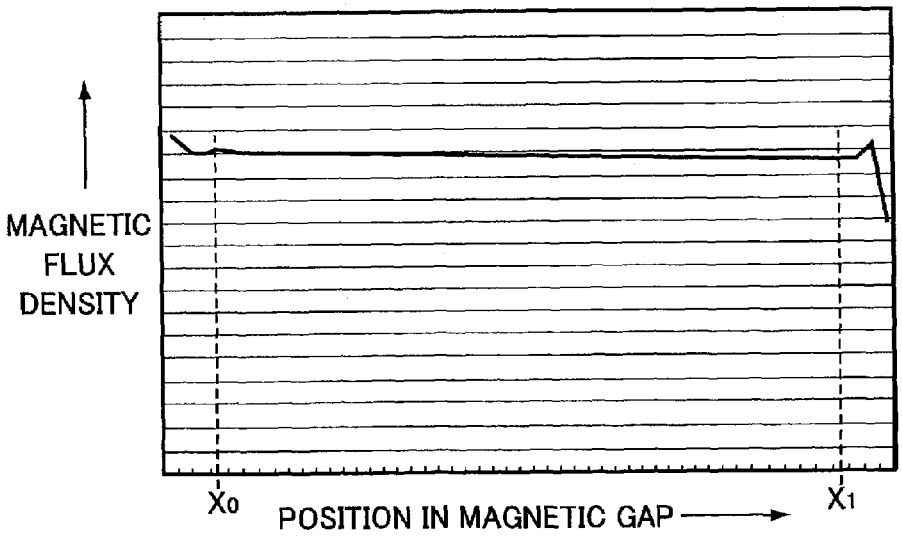
FIG. 5 is a graph showing the magnetic flux density inside the magnetic gap in this magnetic circuit according to the embodiment of the present invention.

FIG. 5 shows the magnetic flux distribution inside the magnetic gap $G_0$ of the internal magnetic circuit according to the embodiment. As can be seen, the magnetic flux density is substantially uniform over the effective length $X_0$–$X_1$ of the magnetic gap $G_0$.

Figure 6:
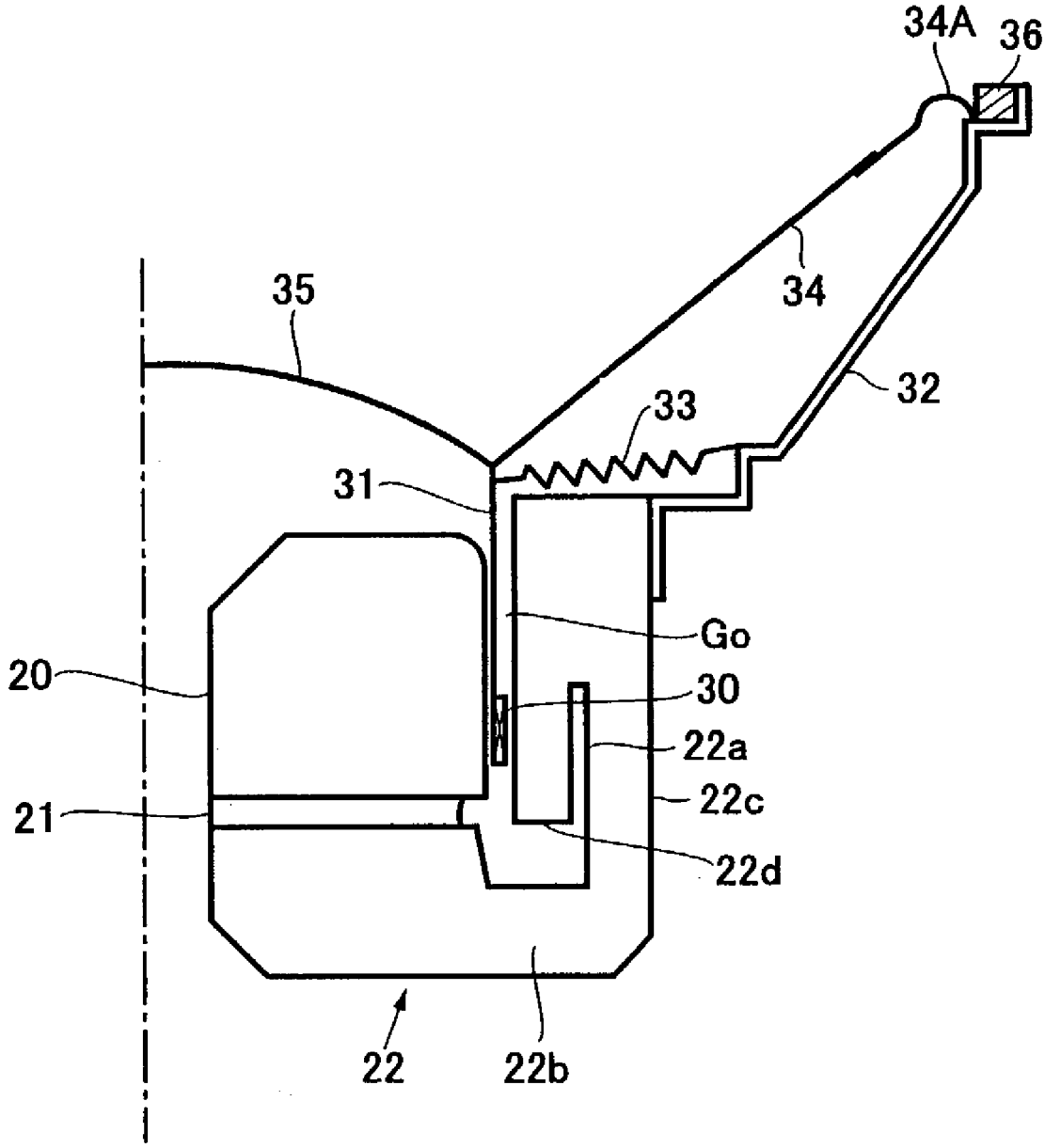
FIG. 6 is an explanatory view showing a loudspeaker system incorporating the internal magnetic circuit according to the embodiment of the present invention.

FIG. 6 is a schematic illustration view of a loudspeaker system incorporating this internal magnetic circuit according to the embodiment. A voice coil bobbin 31 is arranged to surround the plate 20 so that the voice coil 30 is positioned inside the magnetic gap $G_0$. The voice coil 30 has a short winding width so as not to come out of the range of effective length $X_0$–$X_1$ of the magnetic gap $G_0$ during the vibration. The voice coil bobbin 31 is supported on a frame 32 through a damper 33. The inner end of a diaphragm 34 is fixedly attached to the periphery of the voice coil bobbin 31, while the outer end of the diaphragm 34 is supported on the periphery of the frame 32 through an edge 34A. The reference numerals 35 and 36 represent a center cap and a gasket, respectively.

In such a loudspeaker system, the voice coil 30 can cope with large input signals because even a large amplitude vibration stretching over the entire effective length of the magnetic gap $G_0$ of the voice coil 30 will not cause any nonlinear distortion, since the magnetic flux distribution is uniform over the entire effective length of the magnetic gap $G_0$. Thus the loudspeaker system is capable of high-quality, high-power output.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. An internal magnetic circuit comprising:

a magnet;

a plate arranged on one magnetic pole of said magnet;

a yoke arranged on the other magnetic pole of said magnet, said yoke comprising a bottom part attached to a bottom face of said magnet and a side part surrounding said magnet and said plate; and a magnetic gap being formed between said side part of said yoke and said plate, wherein shorter magnetic flux loops crossing said magnetic gap near said magnet are evenly dispersed by elongating a magnetic path length of the shorter magnetic flux loops, thereby a magnetic flux density in said magnetic gap is made uniform.

2. The internal magnetic circuit according to claim 1, wherein said yoke includes a gap for allowing a magnetic flux loop extending across said magnetic gap to detour so that said magnetic path length of said part of magnetic flux can be elongated.

3. An internal magnetic circuit comprising:

a magnet;

a yoke arranged on one magnetic pole of said magnet;

a plate arranged on the other magnetic pole of said magnet; and a magnetic gap being formed between said yoke and said plate, wherein a magnetic flux density inside said magnetic gap is made uniform by elongating a magnetic path length of magnetic flux crossing said magnetic gap near said magnet, and said yoke includes a bottom part attached to a bottom face of said magnet, a side part standing on a side of said plate, and a folded-back part folding downward over said side part such as to face said magnetic gap.

4. A loudspeaker system incorporating the internal magnetic circuit according to claim 1, wherein a voice coil is positioned inside said magnetic gap.

5. A loudspeaker system incorporating the internal magnetic circuit according to claim 2, wherein a voice coil is positioned inside said magnetic gap.

6. A loudspeaker system incorporating the internal magnetic circuit according to claim 3, wherein a voice coil is positioned inside said magnetic gap.

7. The internal magnetic circuit according to claim 1, wherein only the magnetic path length of magnetic flux crossing said magnetic gap across from said magnet is elongated.

* * * * *